US005396201A

United States Patent [19]

Ishizaki et al.

[11] Patent Number: 5,396,201

[45] Date of Patent: Mar. 7, 1995

[54] DIELECTRIC FILTER HAVING INTER-RESONATOR COUPLING INCLUDING BOTH MAGNETIC AND ELECTRIC COUPLING

[75] Inventors: Toshio Ishizaki, Kobe; Mitsuhiro Fujita, Yamatokoriyama; Hikaru Ikeda, Takatsuki; Takashi Fujino, Izumi, all of Japan

[73] Assignee: Matsushita Electric Industrial Co., Ltd., Osaka, Japan

[21] Appl. No.: 135,168

[22] Filed: Oct. 12, 1993

Related U.S. Application Data

[62] Division of Ser. No. 871,698, Apr. 21, 1992, Pat. No. 5,323,128.

[30] Foreign Application Priority Data

Apr. 24, 1991 [JP] Japan ..... 3-94014
Aug. 6, 1991 [JP] Japan ..... 3-196402
Mar. 23, 1992 [JP] Japan ..... 4-64499

[51] Int. Cl.[6] ..... H01P 1/203
[52] U.S. Cl. ..... 333/204; 333/219
[58] Field of Search ..... 333/202–205, 333/219, 246, 185, 238

[56] References Cited

U.S. PATENT DOCUMENTS 4,418,324 11/1983 Higgins ..... 333/204
4,703,291 10/1987 Nishikawa et al. ..... 333/202
4,757,288 7/1988 West ..... 333/206
4,785,271 11/1988 Higgins, Jr. ..... 333/246 X
5,248,949 9/1993 Eguchi et al. ..... 333/204

FOREIGN PATENT DOCUMENTS 58-103202 6/1983 Japan .
61-258503 11/1986 Japan .
3-72706 3/1991 Japan .
1450019 1/1989 U.S.S.R. ..... 333/204

OTHER PUBLICATIONS

Matthaei et al., "Microwave Filters, Impedance Matching Networks, and Coupling Structures", pp. 497–506, 1980.

*Primary Examiner*—Seungsook Ham
*Attorney, Agent, or Firm*—Wenderoth, Lind & Ponack

[57] ABSTRACT

A small and thin plane type narrow-band dielectric filter to be used for a portable telephone and the like, includes a plurality of end short-circuited strip line resonators having a length of about quarter-wavelength formed parallel and closely to each other on a first dielectric substrate and directly magnetically coupled to each other. The thus formed strip line resonators are partially bonded to parallel plane capacitor electrodes formed on a second dielectric substrate in respective overlapping areas thereby electrically coupling the strip line resonators through the parallel plane capacitors, so that the inter-resonator coupling can be reduced due to the fact that it is achieved in combination with the magnetic coupling and the electrical coupling.

34 Claims, 4 Drawing Sheets

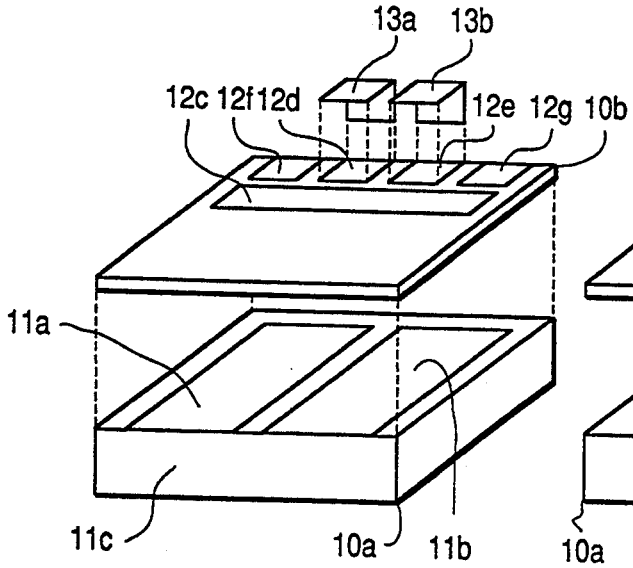
FIG. 1(a)
FIG. 1(b)
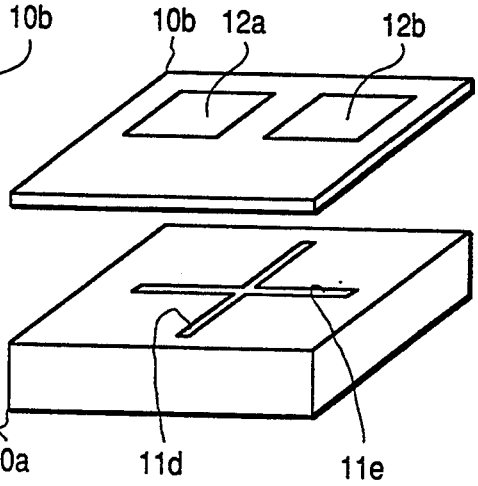
FIG. 1(c)

FIG. 4(a)
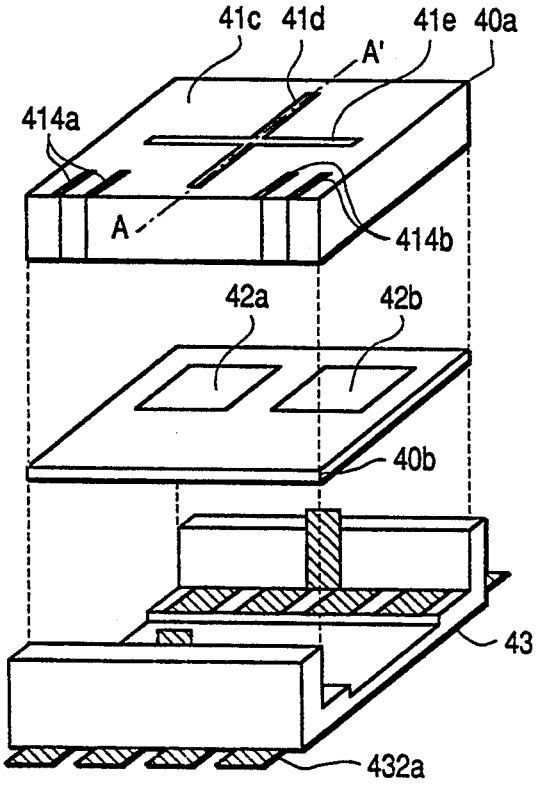
FIG. 4(b)
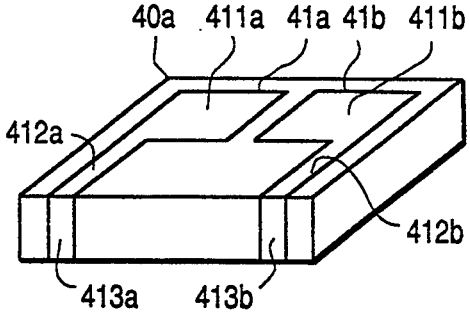
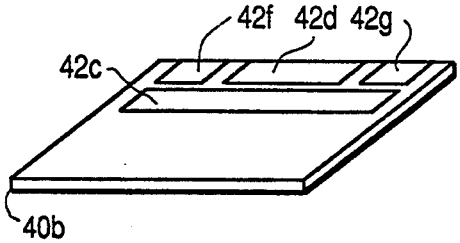
FIG. 4(c)
FIG. 5
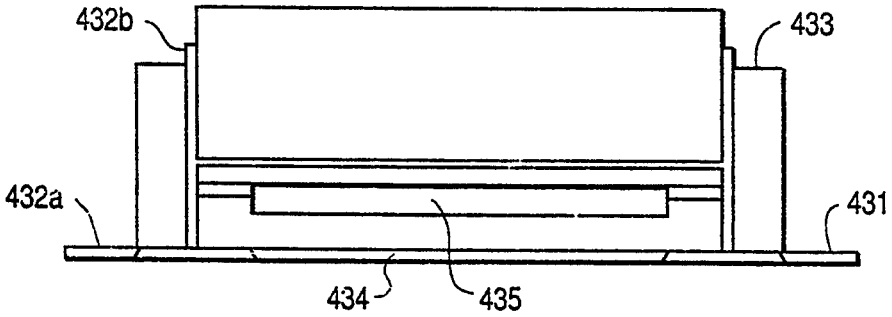

DIELECTRIC FILTER HAVING INTER-RESONATOR COUPLING INCLUDING BOTH MAGNETIC AND ELECTRIC COUPLING

This is a divisional application of Ser. No. 07/871,698, filed Apr. 21, 1992, (U.S. Pat. No. 5,323,128).

BACKGROUND OF THE INVENTION

1. Field of the Invention

This invention relates to a compact planar type dielectric filter to be mainly used in high frequency radio equipment such as a portable telephone set and the like.

2. Description of the Prior Art

Recently, there is an increasingly growing demand for further down-sizing of a planar type dielectric filter which can be made thinner in structure as compared with the coaxial type being widely used for portable telephone sets.

An explanation follows on the operation of a conventional dielectric filter of a laminated planar type as an example. A conventional planar dielectric filter comprises two thick dielectric layers, a first dielectric sheet on which two coil electrodes are formed, a second dielectric sheet on which one-side electrodes of two parallel plane capacitors are formed, a third dielectric sheet on which the other side electrodes of the two parallel plane capacitors are formed, a fourth dielectric sheet on which a shield electrode is formed, and a dielectric sheet which serves to protect the electrodes, which are laminated from the bottom in the order of the fourth dielectric sheet, one of the two thick dielectric layers, the first dielectric sheet, the other of the two thick dielectric layers, the second dielectric sheet, the third dielectric sheet and the dielectric sheet for electrode protection. In the dielectric filter constructed as above, the parallel plane capacitors are formed respectively between the capacitor electrodes confronting each other. The parallel plane capacitors are connected through respective side electrodes to the coil electrodes in series to serve to act as a resonance circuit. The two coils are magnetically coupled to each other, and the input/output terminals are taken intermediately of the coil electrodes, thus forming a band-pass filter. (See, for example, Japanese Laid-Open Patent Publication No. 3-72706.)

With the conventional dielectric filter structured as above, if the coil electrodes are disposed close to each other to decrease the distance therebetween for down-sizing, a problem arises in that a good narrow band band-pass characteristic is not easily realized due to the fact that the magnetic coupling between the resonance circuits becomes too large.

SUMMARY OF THE INVENTION

An object of this invention is to provide a compact planar type dielectric filter capable of providing superior narrow-band band-pass characteristics.

In order to attain the above-mentioned object, a dielectric filter of this invention has a plurality of end short-circuited strip line resonators having a length of about quarter-wavelength formed parallel and closely to each other on a first dielectric substrate so that each two adjacent strip line resonators are directly magnetically coupled to each other. In addition, first electrodes of parallel plane capacitors which are the same in number as the strip line resonators are formed on a first surface of a second dielectric substrate to be laminated on the first dielectric substrate, and a second electrode of the parallel plane capacitors is formed on a second surface of the second dielectric substrate opposing the first surface. The first electrodes are coupled to the electrodes of the strip line resonators at respective mutually overlapping portions so that the strip line resonators can be electrically coupled to each other through the parallel plane capacitors formed between the first electrodes and the second electrode. This means that inter-resonator coupling is made due to the combination of the magnetic coupling and electric coupling.

With the structure as explained above, an equivalent coupling inductance between the end short-circuited strip line resonators becomes relatively larger than that between the coil electrodes of lumped constant elements, so that the inter-resonator coupling can be reduced. In addition, the coupling inductance component can be easily cancelled by the capacitance component of the parallel plane capacitors inserted in parallel, so that the inter-resonator coupling can be further reduced. As a result, a compact planar type dielectric filter having superior narrows-band band-pass characteristics can be realized.

BRIEF DESCRIPTION OF THE DRAWINGS

FIG. 1(*a*) i s an exploded perspective view of a dielectric filter according to a first embodiment of this invention.

FIG. 1(*b*) is a perspective view showing a first surface of a second dielectric substrate shown in FIG. 1(*a*).

FIG. 1(*c*) is a perspective view slowing a ground electrode on the back surface of the first dielectric substrate shown in FIG. 1(*a*).

FIG. 2(*b*) is another equivalent circuit of the circuit shown in FIG. 2(*a*) expressed by using lumped constant elements.

FIG. 2(*c*) is still another equivalent circuit obtained by further equivalently changing the circuit shown in FIG. 2(*b*).

FIG. 4(*a*) is an exploded perspective view of a dielectric filter according to a second embodiment of this invention.

FIG. 4(*b*) is a perspective view showing electrodes of strip line resonators formed on a first dielectric substrate shown in FIG. 4(*a*).

FIG. 4(*c*) is a perspective view showing a second surface of a second dielectric substrate shown in FIG. 4(*a*).

FIG. 5 is a cross-sectioned view of the dielectric filter shown in FIG. 4(*a*).

DESCRIPTION OF THE PREFERRED EMBODIMENTS

A dielectric filter according to a first embodiment of this invention will be described below while referring to the accompanying drawings.

FIG. 1(*a*) is an exploded perspective view of a dielectric filter having a two-pole structure according to the first embodiment. In FIG. 1(*a*), element 10*a* is a first dielectric substrate; elements 11*a* and 11*b* are end short-circuited strip line resonators of substantially a quarter-wavelength and element 11*c* is a ground electrode. In addition, element 10*b* is a second dielectric substrate to be laminated onto the first dielectric substrate 10*a*. FIG. 1(*b*) shows a first surface of the second dielectric substrate 10*b* for contacting with the first dielectric substrate 10*a*. In this first surface, first electrodes 12*a* and 12*b* of parallel plane capacitors the number of which is the same as the number of the resonators are formed so as to partially overlap the open-circuited ends of respective electrode patterns of the strip line resonators 11*a* and 11*b*. FIG. 1(*a*) shows a second surface of the second dielectric substrate 10*b*. On this second surface, a second electrode 12*c* of the parallel plane capacitors so as to partially confront all of the first electrodes of the parallel plane capacitors and to constitute one area as the whole. In addition, third electrodes 12*d* and 12*e* of the parallel plane capacitors are partially formed on the second surface of the second dielectric substrate in areas so as to confront the first electrodes thereof and so that the second electrode is not formed, and grounded through connecting electrode terminals 13*a* and 13*b*. In addition, fourth electrodes 12*f* and 12*g* of the parallel plane capacitors are partially formed on the second surface of the second dielectric substrate in areas so as to confront to the first electrodes thereof and so that the second and third electrodes are not formed, thus being electrically connected to an external circuit through the capacitors formed by the fourth electrodes and first electrodes. The strip line resonator electrodes and ground electrode on the first dielectric substrate, and capacitor electrodes on the second dielectric substrate are all formed by a thick film printing method. The first and second dielectric substrates 10*a* and 10*b* are bonded to each other by applying solder using by a soldering method in respective areas where the open-circuited ends of electrode patterns of the strip line resonators 11*a* and 11*b* are overlapped with the first electrodes 12*a* and 12*b* of the parallel plane capacitors. FIG. 1(*c*) shows the ground electrode on the back side of the first dielectric substrate 10*a*, in which elements 11*d* and 11*e* are controlling slits for controlling the coupling between the resonators.

Figure 2A:
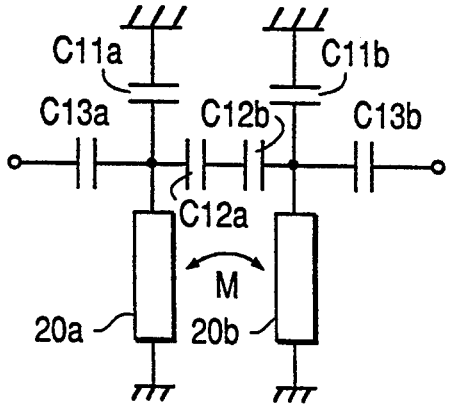
FIG. 2(*a*) is an equivalent circuit diagram for explaining the operation of the dielectric filter shown in FIG. 1(*a*).
Figure 2B:
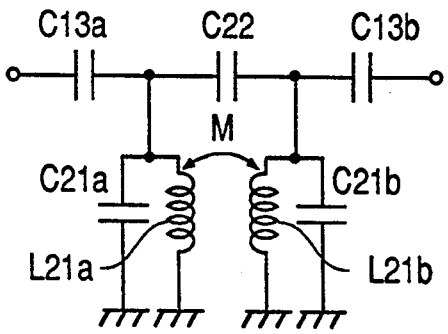
Figure 2C:
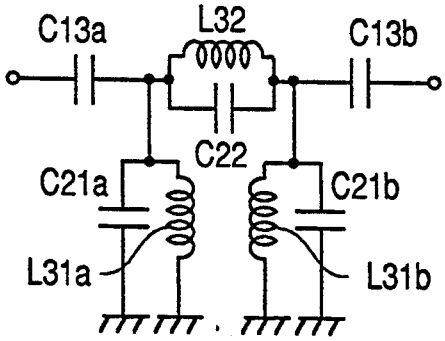

With the dielectric filter structured as above, the operation will be explained below by referring to FIGS. 2(*a*)–2(*c*) and 3. FIG. 2(*a*) is an equivalent circuit diagram of a dielectric filter in accordance with the first embodiment; FIG. 2(*b*) is another equivalent circuit of the circuit shown in FIG. 2(*a*) expressed by using lumped constant elements, and FIG. 2(*c*) is still another equivalent circuit by further equivalently changing the circuit shown in FIG. 2(*b*). In FIG. 2(*a*), strip line resonators 20*a* and 20*b* respectively correspond to the strip line resonators 11*a* and 11*b* shown in FIG. 1(*a*), capacitors C11*a* and C11*b* respectively correspond to the capacitors formed by the third electrodes 12*d* and 12*e* and the first electrodes 12*a* and 12*b* shown in FIGS. 1(*a*)–1(*b*), capacitors C12*a* and C12*b* respectively correspond to the capacitors formed by the second electrode 12*c* and the first electrodes 12*a* and 12*b* shown in FIGS. 1(*a*)–1(*b*), and capacitors 13*a* and 13*b* respectively correspond to the capacitors formed by the fourth electrodes 12*f* and 12*g* and the first electrodes 12*a* and 12*b* shown in FIGS. 1(*a*)–1(*b*). In addition, M is the magnetic coupling between the strip line resonators 20*a* and 20*b*.

In FIG. 2(*b*), inductances L21*a* and L21*b* respectively represent equivalent inductance components of the strip line resonators 20*a* and 20*b*; capacitances C21*a* and C21*b* represent capacitance components of the strip line resonators 20*a* and 20*b*, respectively, and a parallel connection of the capacitances C11*a* and C11*b* shown in FIG. 2(*a*). A capacitance C22 represents a series connection of the capacitances C12*a* and C12*b*.

In FIG. 2(*c*), a coupling inductance L32, inductances L31*a* and L31*b* respectively represent inductances obtained by circuit-changing equivalently the inductances L21*a* and L21*b* and the magnetic coupling M shown in FIG. 2(*b*). Here, when the coupling inductance L32 is large, an impedance to be inserted in series between the resonators becomes large, so that the inter-resonator coupling becomes small.

When the inductances L21*a* and L21*b* are supposed to be equal to each other and expressed as L21, the coupling inductance L32 can be expressed as follows;

$$L32=(L21+M)*(L21/M-1).$$

From this equation, it can be made clear that when L21 is constant, L32 increases with a decrease in M, and when the ratio of L32 to M is constant, L32 increases with an increase in M. The former case corresponds to the case when the space between the strip lines of the resonators is expanded and the latter case corresponds to the case when the line lengths thereof are made large or when the dielectric constant of the first dielectric substrate 10*a* is made large.

Figure 3:
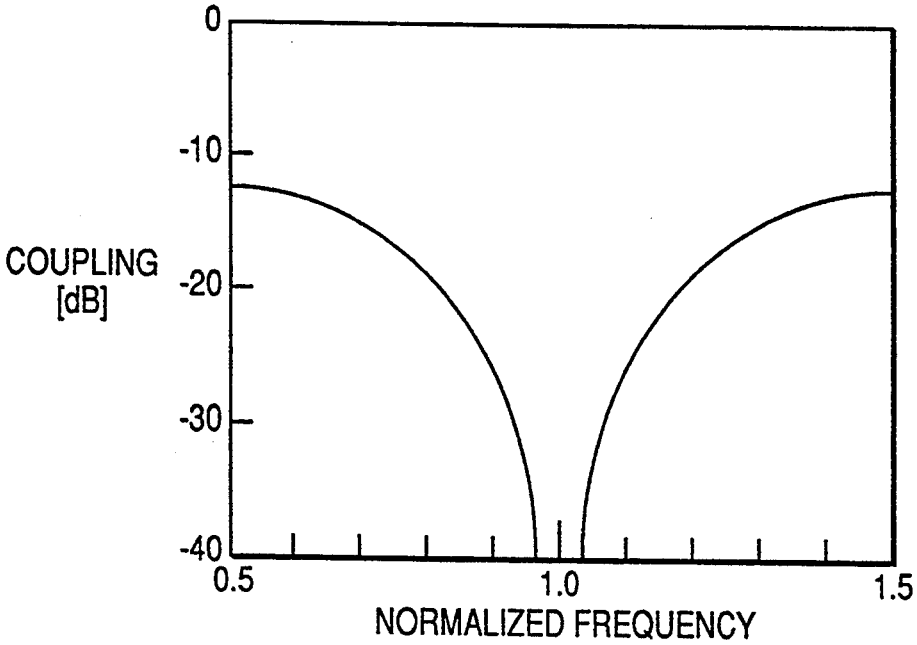
FIG. 3 is a diagram showing a coupling characteristic of an end short-circuited parallel strip line resonator for explaining the operation of the dielectric filter shown in FIG. 1(*a*).

FIG. 3 shows the degree of the inter-resonator coupling of the end short-circuited strip line resonators each having a length equal to one quarter-wavelength and disposed in parallel. In the case of coil resonators, the inter-resonator coupling increases with an increase in the length of the parallel portions. In the case of strip line resonators, the inter-resonator coupling becomes zero when the length thereof becomes just a quarter-wavelength, and small in the vicinity of such a length as above. As a result, in case of using strip line resonators, a desired inter-resonator coupling can be realized by appropriately designing the length thereof.

In addition, the magnetic coupling M can be controlled by providing controlling slit 11*d* or 11*e* on the grounding electrode of the back surface of the strip line resonators. The controlling slit 11*d* parallel to the strip line resonators increases the odd-mode impedance only without changing the even-mode impedance between the parallel strip lines, so that the difference between the two impedances becomes small, and the magnetic coupling M becomes small which is equivalent to a loose coupling of the resonators. The controlling slit 11*e* perpendicular to the strip line resonators causes the electric current on the grounding electrode to be bypassed, resulting in the insertion of an inductance component between the resonators. As a result, the magnetic coupling M becomes large which is equivalent to a tight coupling of the resonators.

In addition, with the filter constructed according to this embodiment, the capacitance C22 which is a serial combination of the capacitance C12*a* and C12*b* of the parallel plate capacitors inserted between the strip line resonators is connected to the coupling inductance L32 in parallel so as to thereby offset the inductance component. The capacitance C22 and the coupling inductance L32 constitutes a parallel resonance circuit, and the impedance becomes infinite at the resonance frequency, resulting in the forming of an attenuation pole in the transfer characteristic.

As explained above, according to this embodiment, a plurality of end short-circuited strip line resonators having a length of about quarter-wavelength are formed in parallel and close to each other on the first dielectric substrate; the resonators thus adjacently disposed to each other are directly magnetically coupled to each other; the electrodes of the parallel plane capacitors formed on the second dielectric substrate and the strip line electrodes are bonded by applying solder using a soldering method in an area where they overlap each other, so that the strip line resonators are electrically coupled to each other through the parallel plane capacitors, and the inter-resonator coupling can be made a combination of magnetic coupling and electric coupling, thus allowing the inter-resonator coupling to be reduced. As a result, a small and planar type dielectric filter can be realized that has a small inter-resonator coupling and an attenuation pole and exhibits good narrow-band band-pass characteristics.

In addition, according to this embodiment, all the capacitor electrodes necessary for making a filter can be formed on the second dielectric substrate, so that it can be made simple in structure, thus reducing the product variation of the dielectric filters that are produced.

In addition, in the explanations of this embodiment, all of the electrodes to be formed on the strip line resonators and capacitors were formed by the thick film printing technique, but are not limited thereto; all of the electrodes may be formed by means of a plating and etching method.

Further in addition, in this embodiment, the explanations were provided for on a dielectric filter having a two-pole structure; but not limited thereto, such a dielectric filter having more than a two-pole structure can be made by the same method.

A dielectric filter according to a second embodiment of this invention will be described below while referring to the drawings. FIGS. 4(*a*)–4(*c*) are an exploded perspective views of a dielectric filter according to this embodiment, and FIG. 5 is a cross-sectional view of the dielectric filter of this embodiment taken along a line A—A' in FIG. 4(*a*).

In FIG. 4(*a*), element 43 is a resin carrier; element 40*b* is a second dielectric substrate, and element 40*a* is a first dielectric substrate, which are laminated in this order. In addition, element 41*c* is a ground electrode, and elements 41*d* and 41*e* are controlling slits for controlling the inter-resonator coupling. FIG. 4(*a*) shows a first surface of the second dielectric substrate 40*b*. On this first surface, first electrodes 42*a* and 42*b* of parallel plane capacitors whose number is equal to the number of resonators, are formed so as to partially overlap the open-circuited ends of respective electrode patterns of strip line resonators. FIG. 4(*b*) shows the surface of the first dielectric substrate 40*a* on which the electrodes of the strip line resonators are formed, in which elements 41*a* and 41*b* are strip line resonators having a folded structure. FIG. 4(*c*) shows a second surface of the second dielectric substrate 40*b*. On this second surface, a second electrode 42*c* of the parallel plane capacitors is formed so as to partially confront all of the first electrodes of the parallel plane capacitors and to constitute one area as a whole. In addition, a third electrode 42*d* of the parallel plane capacitors is partially formed on the second surface thereof so as to confront the first electrodes thereof in such an area where the second electrode is not formed. The third electrode 42*d* is an electrode disposed such that the electrodes 12*d* and 12*e* shown in FIG. 1(*a*) are formed in one united body and grounded through a metal terminal 432*a* for ground electrode use. Also, fourth electrodes 42*f* and 42*g* of the parallel plane capacitors are partially formed on the second surface thereof to respectively confront the first electrodes thereof in an area where the second and third electrodes are not formed, and are connected to an external circuit through capacitors to be respectively formed by the fourth electrodes 42*f* and 42*g* and the first electrodes 42*a* and 42*b*. In addition, the first and second dielectric substrates 40*a* and 40*b* are bonded to each other by applying solder using a soldering method in such areas such that the open-circuited ends of the electrode patterns of the strip line resonators 41*a* and 41*b* and the first electrodes 42*a* and 42*b* of the parallel plane capacitors are superposed, respectively.

The dielectric filter of this embodiment is different in structure from that of the first embodiment in (1) that the strip line resonators 41*a* and 41*b* having a folded structure are introduced as a resonator, (2) that the bonded substrate body is mounted onto the resin carrier 43, and (3) that the strip line resonators of a groove type are formed on the first dielectric substrate. The structure of the other component parts is substantially the same as that shown in FIGS. 1(*a*)–1(*c*).

With the dielectric filter structured as above, the operation will be explained while emphasizing the different points from that of the first embodiment.

The first different point is that the strip line resonators 41*a* and 41*b* each having a folded structure respectively have the line widths changed from wide width portions 411*a* and 411*b* to narrow width portions 412*a* to 412*b* of the strip line which are shorter than a quarter-wavelength, and connected to respective ground electrodes on the back surface thereof through band-shaped electrodes 413*a* and 413*b* each having the same width as that of the narrow width portion formed on the side of the first dielectric substrate 40*a*. The ground electrodes can be extended in the line length equivalently by providing notched slits 414*a* and 414*b* at respective connecting points, and the resonance frequency can be controlled by changing the lengths of the notched slits. The strip line resonator of the folded structure as shown above can be small-sized without degrading the value of the Q-factor very much. A best combination of the value of Q-factor and the size of the resonator can be obtained when the line widths of the band-shaped electrodes 413*a* and 413*b* are equal to the widths of the narrow width portions 412*a* and 412*b* of the strip line resonators 41*a* and 41*b*. When the line widths of the band-shaped electrodes are smaller than the widths of the narrow width portions, the value of Q-factor will be sacrificed and when the former are larger than the latter, the size of the resonator will be sacrificed.

The second point is that the resin carrier 43 has an integral structure of a resin 433 with a metal terminal 431 for input/output electrode use and a metal terminal 432*a* for ground electrode use. This means that an improvement in terminal strength when the device is used as a surface mounted device (SMD). In addition, for the purpose of shielding the filter, a shield plate 434 which is connected to the metal terminal 432*b* for ground electrode use is provided on the bottom surface of the resin carrier 43. The metal terminal 432*b* for ground electrode use is connected to the ground electrode 41*c* of the first dielectric substrate 40*a* to shield the upper portion of the filter. In order to reduce the filter loss to minimize the degradation of the filter characteristics, it is effective to provide a concave groove 435 on the upper surface of the resin carrier 43 so as to form an air layer between the shield plate 434 and the bonded substrates body of the first and second dielectric substrates 40*a* and 40*b*.

The third point is that the strip line resonators 41*a* and 41*b* to be formed in a groove form on the first dielectric substrate 40*a* are made in such a manner that the grooves to form the resonators are pressure-molded and fired in the process of producing the first dielectric substrate, a thick film electrode material is applied on the entire surface of the substrate, and thereafter, the electrode material applied in the area where the grooves are not formed are removed by a polishing method, thereby forming the electrodes of the strip line resonators. This method is superior in mass-production to the thick film printing method. In this method, the substrate may be entirely immersed in a solution of a thick film electrode material so as to adhere electrode material onto the entire surface of the substrate which then fired, or an electrode material may be plated on the entire surface of the substrate by an electroless plating method, so that strong adhesion of the electrode material on the ceramic substrate can be obtained. As a result, the adhesion of the electrodes and the substrate can be outstandingly improved especially in an area where the strip line resonators at the edge of the substrate are Connected to the respective band-shaped electrodes. Consequently, the electrode resistance to a high-frequency current can be reduced and the loss of resonators can be decreased. In addition, with the groove-type strip line resonator, the high-frequency current can be concentrated in the area where the bottom surface and side surface of the groove are to be in contact to each other. On the other hand, with a general planar type strip line resonator, the high frequency current will be concentrated in a rugged area peripherally of the strip line, and thus, a greater part of the loss of the resonator is generated at such an area. On the other hand, with the groove-type strip line resonator, the electrode in the area where the bottom surface and the side surface thereof contact each other does not have the ragged area that the side area has. Accordingly, the electrode resistance to high-frequency current in the contacting area becomes smaller than in the side area. As a result, the groove-type strip line resonator can be made to have a small resonator loss as compared with the plane-type strip line resonator.

As explained above, the dielectric filter according to this embodiment makes it possible to realize a compact size without degrading the filter characteristic by using a strip line resonator having a folded-type structure. In addition, by using a carrier made of a resin, the terminal electrode strength and shielding property of the filter can be outstandingly improved. Further in addition, by using a groove-type strip line resonator, the loss of the filter can be decreased and the productivity can be outstandingly improved.

Also, in a fashion similar to the first embodiment, it is needless to say that the inter-resonator coupling can be controlled by providing a controlling slit 41*d* or 41*e* on the grounding electrode 41*c* on the back surface thereof. In addition, in combination with the frequency controlling method, by using the notched slits 414*a* and 414*b* of the strip line resonators having a folded structure, the filter characteristic can be controlled only on the back surface of the resonator. This fact is very important for the dielectric filter of this embodiment in which component parts other than the ground electrode on the back surface are substantially covered with the resin carrier.

A dielectric filter according to a third embodiment of this invention will be described below while referring to the drawings.

Figure 6:
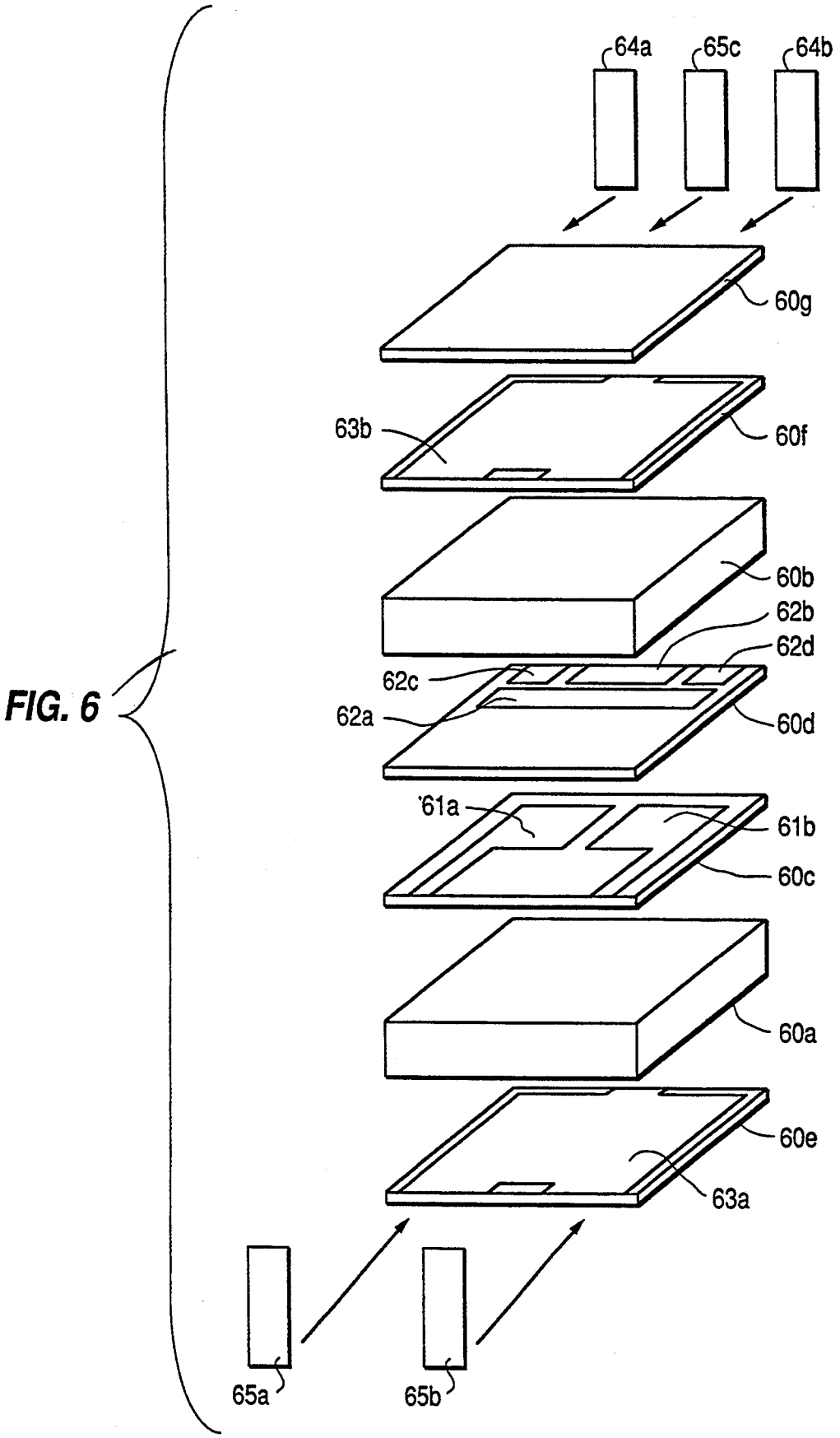
FIG. 6 is an exploded perspective view of a lamination-type dielectric filter according to a third embodiment of this invention.

FIG. 6 is a perspective view of a dielectric filter of the third embodiment, in which elements 60*a* and 60*b* are thick dielectric layers. A dielectric sheet 60*c* has strip line resonator electrodes 61*a* and 61*b* formed thereon, and a dielectric sheet 60*d* has a second electrode 62*a*, a third electrode 62*b* and fourth electrodes 62*c* and 62*d* of parallel plane capacitors formed thereon. The strip line resonator electrodes 61*a* and 61*b* have strip lines whose short-circuited ends are narrowed in width from that of the strip line, that is, narrowed from a wide width portion to a narrow width portion, resulting in realizing down-sizing. In addition, a shield electrode 63*a* is formed on a dielectric sheet 60*e*, and a shield electrode 63*d* is formed on a dielectric sheet 60*f*. These dielectric sheets, dielectric layers and an electrode protective dielectric sheet 60*g* are laminated to obtain a laminated body.

With the dielectric filter structured as explained above, the operation will be explained below.

First, the strip line resonator electrodes 61*a* and 61*b* and the second electrode 62*a*, third electrode 62*b* and fourth electrodes 62*c* and 62*d* which confront the electrodes 61*a* and 61*b* respectively form parallel plane capacitors therebetween. The second electrode 62*a* of the parallel plane capacitors serves to act as an inter-resonator coupling capacitor. The third electrode 62*b* serves to act as a parallel capacitor for lowering the resonance frequency of the strip line resonators. The fourth electrodes 62*c* and 62*d* serve to act as input/output coupling capacitors. The fourth electrodes 62*c* and 62*d* are connected respectively to the side electrodes 64*a* and 64*b* to be used as input/output terminals. The lower shield electrode 63*a* and the upper shield electrode 63*b* are connected to side electrodes 65*a*, 65*b*, and 65*c* respectively to be used as ground terminals.

The dielectric filter of this embodiment is different from that of the first embodiment in that lamination is effected so that the first electrodes of the parallel plane capacitor are used in common with the electrodes of the strip line resonators. The laminated structure according to the third embodiment is simple in structure and small in size as well as being to form a shield. In addition, according to the third embodiment, all the electrodes of the strip line resonators are formed on the dielectric sheet 60*c* and all the capacitor electrodes are formed on the dielectric sheet 60*d* by a printing method, so that the electrode printing may be applied only for two dielectric sheets and two shield electrodes. This means that the number of printing processes can be made small and yet, the variation in the filter characteristics can be reduced.

What is claimed is:

1. A dielectric filter comprising:

a plurality of end short-circuited strip line resonators respectively composed of a plurality of strip lines formed in parallel and close to each other on a surface of a first dielectric sheet so that each two adjacent strip line resonators are directly magnetically coupled to each other;

an inter-resonator coupling capacitor electrode formed on a surface of a second dielectric sheet which is laminated on said first dielectric sheet in such a manner that said inter-resonator coupling capacitor electrode partially confronts all of the strip lines of said strip line resonators through said second dielectric sheet to constitute parallel plane capacitors; and first and second shield electrodes formed respectively on third and fourth dielectric sheets which are disposed so as to sandwich said first and second dielectric sheets therebetween;

said strip line resonators being electrically coupled to each other through said parallel plane capacitors whereby an inter-resonator coupling is effected in combination with said magnetic coupling and electric coupling.

2. A dielectric filter according to claim 1, further comprising an additional dielectric sheet provided on an outermost one of the shield electrodes to protect the outermost shield electrode.

3. A dielectric filter according to claim 1, wherein said first through fourth dielectric sheets are laminated in the order of said third, first, second and fourth dielectric sheets with a first thick dielectric plate disposed between said third and first dielectric sheets and with a second thick dielectric plate disposed between said second and fourth dielectric sheets so that each of a distance between said shield electrode on said third dielectric sheet and said strip lines of said strip line resonators and a distance between said shield electrode on said fourth dielectric sheet and said inter-resonator coupling capacitor electrode is larger than a distance between said strip lines of said strip line resonators and said inter-resonator coupling capacitor electrode.

4. A dielectric filter according to claim 1, further comprising at least two external ground electrodes respectively formed on different side surfaces of a laminated body comprising said first through fourth dielectric sheets and connected to said shield electrodes.

5. A dielectric filter according to claim 1, further comprising at least two external ground electrodes respectively formed on opposite side surfaces of a laminated body comprising said first through fourth dielectric sheets and connected to said shield electrodes, a pattern of said external ground electrodes on one of said opposite side surfaces being different from a pattern of said external ground electrodes on the other of said opposite side surfaces.

6. A dielectric filter according to claim 1, wherein short-circuited ends of all of said strip line resonators extend to a same side surface of said first dielectric sheet and are connected to an external ground electrode formed on a side surface of a laminated body comprising said first through fourth dielectric sheets.

7. A dielectric filter according to claim 6, wherein another external ground electrode is formed on a side surface of the laminated body comprising said first through fourth dielectric sheets closer to open-circuited ends of said strip line resonators.

8. A dielectric filter according to claim 1, further comprising an external input terminal electrode and an external output terminal electrode which are formed on one side surface of a laminated body comprising said first through fourth dielectric sheets, and an external ground electrode formed between said external input and output terminal electrodes on said one side surface.

9. A dielectric filter according to claim 1, wherein said shield electrode on each of said third and fourth dielectric sheets is formed to leave a margin along the periphery of the corresponding dielectric sheet.

10. A dielectric filter according to claim 1, wherein said shield electrodes formed on said third and fourth dielectric sheets are of the same shape.

11. A dielectric filter according to claim 1, wherein a line width of a short-circuited end of a strip line of each of said strip line resonators is narrower than a line width of an open-circuited end of said strip line.

12. A dielectric filter comprising:

at least one first dielectric sheet having formed thereon a plurality of end short-circuited strip line resonators respectively composed of a plurality of strip lines which are formed in parallel and close to each other so that each two adjacent strip line resonators are directly magnetically coupled to each other;

at least one second dielectric sheet having at least one inter-resonator coupling capacitor electrode formed thereon, said second dielectric sheet being laminated on said first dielectric sheet; and third and fourth dielectric sheets each having a shield electrode formed thereon;

said first through fourth dielectric sheets being laminated such that said inter-resonator coupling capacitor electrode partially confronts at least two of said strip lines of said strip line resonators through said second dielectric sheet to constitute a parallel plane capacitor and such that said third and fourth dielectric sheets sandwich said first and second dielectric sheets therebetween so as to shield said strip line resonators and said parallel plane capacitor with said shield electrodes;

said strip line resonators being electrically coupled to each other through said parallel plane capacitors whereby an inter-resonator coupling is effected in combination with said magnetic coupling and electric coupling.

13. A dielectric filter according to claim 12, wherein said at least one first dielectric sheet disposed between said third and fourth dielectric sheets is a single dielectric sheet having said strip lines formed thereon, wherein said strip lines are formed from a single conductive layer formed on said single dielectric sheet.

14. A dielectric filter according to claim 12, wherein said at least one second dielectric sheet disposed between said third and fourth dielectric sheets is a single dielectric sheet having said inter-resonator coupling capacitor electrode formed thereon.

15. A dielectric filter according to claim 12, further comprising an additional dielectric sheet provided on an outermost one of the shield electrodes to protect the outermost shield electrode.

16. A dielectric filter according to claim 12, wherein said first through fourth dielectric sheets are laminated in the order of said third, first, second and fourth dielectric sheets with a first thick dielectric plate disposed between said third and first dielectric sheets and with a second thick dielectric plate disposed between said second and fourth dielectric sheets so that each of a distance between said shield electrode on said third dielectric sheet and said inter-resonator coupling capacitor electrode is larger than a distance between said strip lines of said strip line resonators and said inter-resonator coupling capacitor electrode.

17. A dielectric filter according to claim 12, further comprising at least two external ground electrodes respectively formed on different side surfaces of a laminated body comprising said first through fourth dielectric sheets and connected to said shield electrodes.

18. A dielectric filter according to claim 12, further comprising at least two external ground electrodes respectively formed on opposite side surfaces of a laminated body comprising said first through fourth dielectric sheets and connected to said shield electrodes, a pattern of said external ground electrodes on one of said opposite side surfaces being different from a pattern of said external ground electrodes on the other of said opposite side surfaces.

19. A dielectric filter according to claim 12, wherein short-circuited ends of all of said strip line resonators extend to a same side surface of said first dielectric sheet and are connected to an external ground electrode formed on a side surface of a laminated body comprising said first through fourth dielectric sheets.

20. A dielectric filter according to claim 19, wherein another external ground electrode is formed on a side surface of the laminated body comprising said first through fourth dielectric sheets closer to open-circuited ends of said strip line resonators.

21. A dielectric filter according to claim 12, further comprising an external input terminal electrode and an external output terminal electrode which are formed on one side surface of a laminated body comprising said first through fourth dielectric sheets, and an external ground electrode formed between said external input and output terminal electrodes on said one side surface.

22. A dielectric filter according to claim 12, wherein said shield electrode on each of said third and fourth dielectric sheets is formed to leave a margin along the periphery of its corresponding dielectric sheet.

23. A dielectric filter according to claim 12, wherein said shield electrodes formed on said third and fourth dielectric sheets are of the same shape.

24. A dielectric filter according to claim 12, wherein a line width of a short-circuited end of a strip line of each said strip line resonators is narrower than a line width of an open-circuited end of said strip line.

25. A dielectric filter comprising:

a first dielectric sheet having opposite first and second surfaces;

a plurality of end short-circuited strip line resonators respectively composed of a plurality of strip lines each having a length of about quarter-wavelength formed in parallel and close to each other on said first surface of said first dielectric sheet so that each two adjacent said strip line resonators are directly magnetically coupled to each other;

a second dielectric sheet having opposite first and second surfaces and laminated on said first dielectric sheet such that said second surface of said second dielectric sheet contacts said first surface of said first dielectric sheet;

a capacitor electrode formed on said first surface of said second dielectric sheet in such a manner that said capacitor electrode partially confronts all of the strip lines of said strip line resonators through said second dielectric sheet to constitute parallel plane capacitors so that said strip line resonators are electrically coupled to each other through said parallel plane capacitors whereby an inter-resonator coupling is effected in combination with said magnetic coupling and electric coupling;

a third dielectric sheet having opposite first and second surfaces;

a first shield electrode formed on said first surface of said third dielectric sheet, said third dielectric sheet being laminated on said second surface of said first dielectric sheet via a first dielectric plate interposed therebetween so that said first surface of said third dielectric sheet confronts said second surface of said first dielectric sheet;

a fourth dielectric sheet having opposite first and second surfaces;

a second shield electrode formed on said first surface of said fourth dielectric sheet, said fourth dielectric sheet being laminated on said first surface of said second dielectric sheet via a second dielectric plate interposed therebetween so that said second surface of said fourth dielectric sheet confronts said first surface of said second dielectric sheet; and a fifth dielectric sheet laminated on said first surface of said fourth dielectric sheet to protect said second shield electrode.

26. A dielectric filter according to claim 25, further comprising a second capacitor electrode formed on said first surface of said second dielectric sheet so as to partially confront said strip lines of said strip line resonators to thereby constitute second parallel plane capacitors, said second capacitor electrode is connected to a ground.

27. A dielectric filter according to claim 25, further comprising a third capacitor electrode formed on said first surface of said second dielectric sheet so as to partially confront one of said strip lines of said strip line resonators to thereby constitute a third parallel plane capacitor, and a fourth capacitor electrode formed on said first surface of said second dielectric sheet so as to partially confront another of said strip lines of said strip line resonators to thereby constitute a fourth parallel plane capacitor, said third and fourth capacitor electrodes are respectively connected to input and output terminal electrodes formed on a side surface of a laminated body comprising said first through fifth dielectric sheets and said first and second dielectric plates.

28. A dielectric filter according to claim 25, wherein short-circuited ends of all of said strip line resonators extend to a same side surface of said first dielectric sheet and are connected to a ground electrode formed on a side surface of a laminated body comprising said first through fifth dielectric sheets and said first and second dielectric plates.

29. A dielectric filter comprising:

a first dielectric sheet having opposite first and second surfaces;

two end short-circuited strip line resonators respectively composed of two strip lines each having a length of about quarter-wavelength formed in parallel and close to each other on said first surface of said first dielectric sheet so that said two strip line resonators are directly magnetically coupled to each other;

a second dielectric sheet having opposite first and second surfaces and laminated on said first dielectric sheet such that said second surface of said second dielectric sheet contacts said first surface of said first dielectric sheet;

a capacitor electrode formed on said first surface of said second dielectric sheet in such a manner that said capacitor electrode partially confronts the strip lines of said two strip line resonators through said second dielectric sheet to constitute parallel plane capacitors so that said strip line resonators are electrically coupled to each other through said parallel plane capacitors whereby an inter-resonator coupling is effected in combination with said magnetic coupling and electric coupling;

a third dielectric sheet having opposite first and second surfaces;

a first shield electrode formed on said first surface of said third dielectric sheet, said third dielectric sheet being laminated on said second surface of said first dielectric sheet via a first dielectric plate interposed therebetween so that said first surface of said third dielectric sheet confronts said second surface of said first dielectric sheet;

a fourth dielectric sheet having opposite first and second surfaces;

a second shield electrode formed on said first surface of said fourth dielectric sheet, said fourth dielectric sheet being laminated on said first surface of said second dielectric sheet via a second dielectric plate interposed therebetween so that said second surface of said fourth dielectric sheet confronts said first surface of said second dielectric sheet; and a fifth dielectric sheet laminated on said first surface of said fourth dielectric sheet to protect said second shield electrode.

30. A dielectric filter according to claim 29, further comprising a second capacitor electrode formed on said first surface of said second dielectric sheet so as to partially confront said strip lines of said two strip line resonators to thereby constitute second parallel plane capacitors, said second capacitor electrode being connected to a ground.

31. A dielectric filter according to claim 29, further comprising a third capacitor electrode formed on said first surface of said second dielectric sheet so as to partially confront one of said strip lines of said two strip line resonators to thereby constitute a third parallel plane capacitor, and a fourth capacitor electrode formed on said first surface of said second dielectric sheet so as to partially confront another of said strip lines of said two strip line resonators to thereby constitute a fourth parallel plane capacitor, said third and fourth capacitor electrodes being respectively connected to input and output terminal electrodes formed on a side surface of a laminated body comprising said first through fifth dielectric sheets and said first and second dielectric plates.

32. A dielectric filter according to claim 29, wherein short-circuited ends of said two strip line resonators extend to a same side surface of said first dielectric sheet and are connected to an external ground electrode formed on a side surface of a laminated body comprising said first through fifth dielectric sheets and said first and second dielectric plates.

33. A dielectric filter comprising:

at least one first dielectric sheet having formed thereon a plurality of end short-circuited strip line resonators respectively composed of a plurality of strip lines where are formed in parallel and close to each other so that each two adjacent strip line resonators are directly magnetically coupled to each other, wherein short-circuited ends of all of said strip line resonators extend to a same side surface of said first dielectric sheet and are connected to a first external ground electrode;

at least one second dielectric sheet having at least one loading capacitor electrode formed thereon, said second dielectric sheet being laminated on said first dielectric sheet and said loading capacitor electrode being connected to a second external ground electrode; and third and fourth dielectric sheets each having a shield electrode formed thereon, said shield electrodes being connected to said first and second external ground electrodes;

said first through fourth dielectric sheets being laminated such that said loading capacitor electrode partially confronts at least one of said strip lines of said strip line resonators through said second dielectric sheet to constitute a parallel plane capacitor and such that said third and fourth dielectric sheets sandwich said first and second dielectric sheets therebetween so as to shield said strip line resonators and said parallel plane capacitor with said shield electrodes;

said first and second external ground electrodes being formed on different side surfaces of a laminated body comprising said first through fourth dielectric sheets.

34. A dielectric filter comprising:

at least one first dielectric sheet having formed thereon a plurality of end short-circuited strip line resonators respectively composed of a plurality of strip lines which are formed in parallel and close to each other so that each two adjacent strip line resonators are directly magnetically coupled to each other, wherein short-circuited ends of all of said strip line resonators extend to a same side surface of said first dielectric sheet and are connected to a first external ground electrode;

at least one second dielectric sheet laminated on said first dielectric sheet;

a first capacitor electrode formed on said second dielectric sheet so as to partially confront one of said end short-circuited strip line resonators through said second dielectric sheet to thereby constitute a first parallel plane capacitor;

a second capacitor electrode formed on said second dielectric sheet so as to partially confront another of said end short-circuited strip line resonators through said second dielectric sheet to thereby constitute a second parallel plane capacitor;

third and fourth dielectric sheets each having a shield electrode formed thereon, said first through fourth dielectric sheets being laminated such that said third and fourth dielectric sheets sandwich said first and second dielectric sheets therebetween so as to shield said strip line resonators and said parallel plane capacitors with said shield electrodes; and a second external ground electrode formed on another side surface of the laminated body comprising said first through fourth dielectric sheets closer to open-ends of said strip line resonators, said shield electrodes being connected to said first and second external ground electrodes;

said first and second capacitor electrodes being respectively connected to external input and output terminal electrodes formed on a side surface of a laminated body comprising said first through fourth dielectric sheets.

* * * * *